12P-24 A AU 337 EX
6/24/86 V4 4,596,171

United States Patent [19]

Gerber

[11] Patent Number: 4,596,171

[45] Date of Patent: Jun. 24, 1986

[54] METHOD AND APPARATUS FOR ULTRASONICALLY CUTTING SHEET MATERIAL

[75] Inventor: Heinz J. Gerber, West Hartford, Conn.

[73] Assignee: Gerber Garment Technology, Inc., South Windsor, Conn.

[21] Appl. No.: 543,467

[22] Filed: Oct. 19, 1983

[51] Int. Cl.[4] ..... D06H 7/00; B26D 1/06

[52] U.S. Cl. ..... 83/56; 83/13; 83/701; 83/71; 83/925 CC; 83/746; 83/749; 408/700; 408/22; 128/24 A; 51/59 SS

[58] Field of Search ..... 83/701, 71, 925 CC, 83/13, 56, 746, 747, 749, 750; 408/700, 22; 310/325; 128/24 A, 317; 51/59 SS

[56] References Cited

U.S. PATENT DOCUMENTS

| | | | |
|---|---|---|---|
| 2,384,435 | 9/1945 | Bodine | 83/530 X |
| 3,614,484 | 10/1971 | Shoh | 408/700 |
| 3,730,634 | 5/1973 | Gerber et al. | 408/22 |
| 4,201,101 | 5/1980 | Gerber | 83/925 CC |
| 4,373,412 | 2/1983 | Gerber et al. | 83/71 X |

*Primary Examiner*—Donald R. Schran

*Attorney, Agent, or Firm*—McCormick, Paulding & Huber

[57] ABSTRACT

An automatically controlled cutting machine having a reciprocating cutting blade that is translated along a cutting path through a layup of limp sheet material under computer control includes an ultrasonic transducer that establishes standing waves along the length of the blade. The reciprocating motions of the blade shift the nodes in the standing wave to different elevations within the layup so that cutting is uniform in each ply of the limp sheet material. A drill used to produce marking holes in the material is also provided with ultrasonic means and aids the drilling in penetrating through the layup during drilling operations.

6 Claims, 5 Drawing Figures

METHOD AND APPARATUS FOR ULTRASONICALLY CUTTING SHEET MATERIAL

BACKGROUND OF THE INVENTION

The present invention relates to automatically controlled cutting machines that are used to cut limp sheet material, such as woven and nonwoven cloth, paper, leather, synthetics, composite materials, and others.

Reciprocated cutting blades in automatically controlled cloth cutting equipment are well known in the art and are shown in U.S. Pat. No. 3,495,492 and others. The cutting blade is typically a thin elongated blade having a sharp leading cutting edge that is advanced through the sheet material on a predefined line of cut while the blade is simultaneously reciprocated in a direction generally perpendicular to the material.

More recently, it has been recognized that cutting of limp sheet material can be performed with the aid of ultrasonic vibrations. U.S. Pat. No. 4,373,412 issued to Gerber and Pearl discloses a cutting machine in which a cutting wheel having a sharp peripheral cutting edge is vibrated ultrasonically as the wheel rolls across a hard cutting surface on which the sheet material is positioned for cutting. The ultrasonic vibrations are believed to assist in the cutting operation by crushing the material between the cutting edge and the support surface. U.S. Pat. No. 3,378,429 issued to Obeda also discloses an ultrasonically activated tool to slit and seal textile materials made of synthetic fibers.

The prior art cutting tools mentioned above vibrate a cutting edge toward and away from a support surface on which the sheet material is positioned or moved to accomplish the cutting operation. However, in the manufacture of clothing, upholstery, and other items at large scale, the sheet material is generally cut in multi-ply layups, and the concept of using a support surface as an anvil in conjunction with an ultrasonically vibrated cutting tool cannot be employed.

It is accordingly a general object of the present invention to provide an automatically controlled cutting apparatus and method in which multi-ply layups of sheet material can be cut with the aid of ultrasonics. It is a further object of the invention to provide apparatus and method for drilling through multi-ply layups of sheet material with the aid of ultrasonics.

SUMMARY OF THE INVENTION

The present invention resides in an automatically controlled cutting apparatus for cutting limp sheet material in multi-ply layups. The apparatus, which also performs the method of the invention, includes support means defining a penetrable support surface for holding limp sheet material during cutting. A cutting head is mounted for movement relative to the penetrable support surface and includes an elongated cutting blade with reciprocation drive means for reciprocating the blade along an axis extending generally perpendicular to the penetrable surface. The cutting blade has a sharp leading cutting edge that is reciprocated and advanced through the limp sheet material along a cutting path in cutting engagement with the material.

The improvement in this apparatus includes in the reciprocation drive means a drive linkage having ultrasonic transducer means for superimposing on the reciprocating motions of the blade ultrasonic vibrations. The transducer means establishes a standing wave along the length of the elongated cutting blade, and the reciprocations of the blade ensure that the nodes in the standing wave are moved up and down in the layup of material so that uniform cutting takes place and the advantage of the ultrasonic assistance is fully enjoyed in each ply of the layup. A drilling tool in the cutting machine is also provided with ultrasonic transducer means to render drilling operations more effective.

DESCRIPTION OF THE PREFERRED EMBODIMENTS

Figure 1:
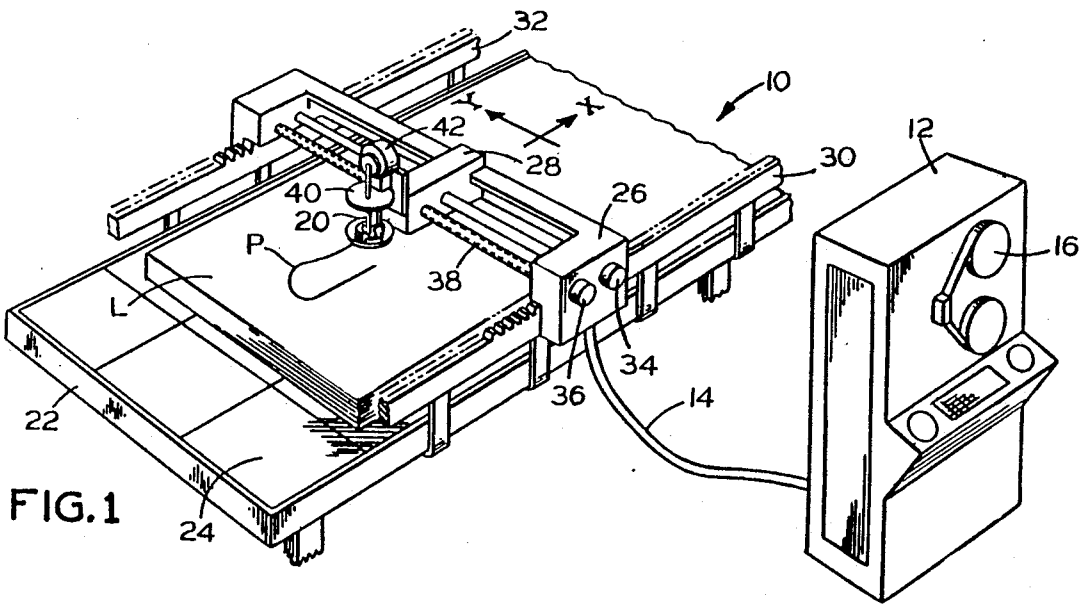
FIG. 1 is a perspective view of an automatically controlled cutting machine in which the present invention is embodied.

FIG. 1 illustrates an automatically controlled cutting machine, generally designated 10, of the type shown and described in great detail in U.S. Pat. No. 3,495,492 referenced above. The machine 10 is utilized to cut pattern pieces from single or multi-ply layups of limp sheet material spread on the machine. The illustrated machine 10 is a numerically controlled machine having a control computer 12 and a cutting table 22 which performs cutting operations in response to machine commands transmitted to the table from the computer through an electrical cable 14. The machine may cut a marker or array of pattern pieces from the sheet material for garments, upholstery, and numerous other products.

The computer 12 reads digitized data from a pattern or marker program tape 16 defining the contours of pattern pieces to be cut and then generates machine command signals for guiding a reciprocating cutting blade 20 as the cutting operation is carried out. In the numerically controlled embodiment of the cutting machine, the cutting paths P to be followed in the layup L are reduced to point data in a digitizing process, and such point data is then recorded on the program tape 16. The point data actually defines the end points of linear or curved line segments which in a serial arrangement correspond to the cutting path P.

Before the program tape 16 is read by the computer 12, the computer receives or is inherently constructed with a basic machine program containing servo and curve algorithms which are peculiar to the cutting table 22. This machine program enables the computer 12 to convert point data defining specific contours to be cut in the layup L into machine commands which are intelligible to the cutting table and which cause the cutting blade 20 to move along a programmed cutting path relative to the layup. It should be understood, however, that the present invention is not limited to the disclosed numerical control system but has utility with other real time and preprocessed data systems including line followers and analog computers.

The cutting table 22 as disclosed has a penetrable bed 24 defining a flat surface supporting the layup L during cutting. The bed may be comprised of a foamed plastic material or preferably a bed of bristles which are easily penetrated by the cutting blade 20 without damage to either the bed or the blade as the cutting path P is traversed. The bed may also employ a vacuum system such as illustrated and described in greater detail in the referenced U.S. Pat. No. 3,495,492 for compressing and rigidizing the layup firmly in position on the table.

The cutting blade 20 is suspended above the support surface of the bed 24 by means of an X-carriage 26 and a Y-carriage 28. The X-carriage translates back and forth in the illustrated X-coordinate direction on a set of racks 30 and 32. The racks are engaged by pinions driven by a X-drive motor 34 in response to command signals from the computer 12. The Y-carriage 28 is mounted on the X-carriage 26 for movement relative to the X-carriage in the Y-coordinate direction and is translated by the Y-drive motor 36 and a lead screw 38 connected between the motor and carriage. Like the drive motor 34, the drive motor 36 is energized by command signals from the computer 12. Coordinated movements of the carriages 26 and 28 are produced by the computer in response to the digitized data taken from the program tape 16 and guide the reciprocating cutting blade 20 along a cutting path P. Thus, the cutting blade is utilized to cut pattern pieces over any portion of the table supporting the sheet material.

The cutting blade 20 is mounted in a cutting head comprised principally of a platform 40 mounted in cantilever fashion at the projecting end of the Y-carriage 28.

Figure 2:
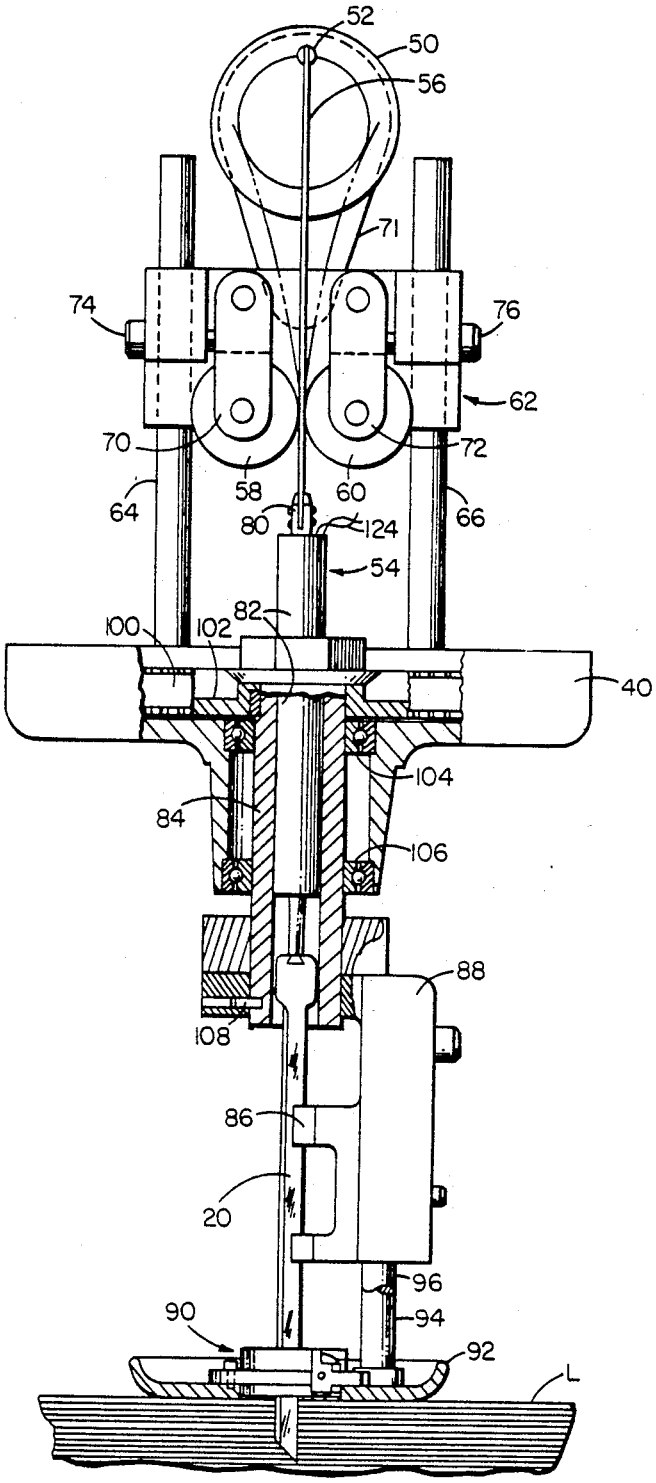
FIG. 2 is an elevation view of the cutting head in the machine of FIG. 1 and shows the elongated cutting blade and the drive means that reciprocates the blade.

FIG. 2 shows the details of the cutting head including the mounting for the cutting blade 20 which allows the blade to be moved between an elevated position out of engagement with the sheet material and a lowered position in engagement with the sheet material as shown. Additionally, the cutting blade is rotated about an axis extending generally perpendicular to the material so that the blade can be oriented into alignment with cutting paths that extend in the sheet material at any angle to the X and Y axes.

The cutting blade 20 is generally supported by a reciprocation drive means that includes an eccentric 50 rotatably driven by the motor 42 in FIG. 1. The eccentric has an offset connecting pin 52, and a reciprocating drive linkage, generally designated 54, extends between the pin 52 and the cutting blade 20. At the upper end, the drive linkage includes a flexible link 56 that connects directly to the pin 52 and extends downwardly generally in the direction of the axis of reciprocation between two guide rollers 58 and 60. The guide rollers from part of a guide assembly, generally designated 62, which slides up and down on a pair of rods 64, 66 fixedly secured to the platform 40. The guide assembly is moved vertically along the rods in conjunction with the eccentric 50 and its associated drive motor by means of a connecting link 71 and a lifting motor (not shown). With the vertical movement of the guide assembly, the cutting blade is lifted in and out of cutting engagement with the sheet material layup L. For further disclosure of the cutting head mounting structure and operation on the Y-carriage 28, reference is made to U.S. Pat. No. 4,033,214 issued to Pearl.

The cutting blade 20 is reciprocated during a cutting operation by energizing the motor 42 (FIG. 1) and rotating the eccentric 50. The lower portion of the flexible link 56 is held in a generally centered position by the guide rolls 58 and 60 so that the upper portion flexes between the limits shown in phantom. The guide rolls are held in a generally centered position at the depending end of links 70, 72 by means of adjustable cap screws 74, 76.

A swivel joint 80 in the drive linkage 54 connects the lower end of the flexible link 56 to a cylindrical housing 82. The cylindrical housing 82 is guided along the axis of reciprocation within the central bore of a support shaft 84 which serves as an upper guide for the cutting blade. An intermediate blade guide 86 is suspended from the shaft 84 by means of a support bracket 88, and a lower blade guide 90 is mounted within a presser foot 92 at the lower end of the bracket by a pair of support posts 94, 96. The support posts slide within the support bracket 88 to permit the presser foot to rest upon a layup L under its own weight during a cutting operation. For further details on the construction of the lower blade guide 90, reference may be had to U.S. Pat. No. 4,091,701 to Pearl.

When the eccentric 50, the guide assembly 62, and the cutting blade 20 are elevated so that the blade is out of engagement with the sheet material, the intermediate blade guide 56 and the support shaft 84 provide vertical alignment for the blade. When the eccentric, the guide assembly, and the cutting blade are moved to a lower position to bring the blade into cutting engagement with the material, the lower guide 90 also assists in blade alignment and absorbs the principal cutting loads applied to the blade.

The cutting blade 20 is rotated about the central axis of the support shaft 84, which corresponds to the axis of reciprocation, by means of an orientation servomotor (not shown) mounted on the platform 40 and a toothed drive belt 100 between the servomotor and corresponding drive pulley 102 that is keyed to the upper end of the shaft 84. For this purpose, the shaft 84 is journaled by bearings 104, 106 within the platform 40, and the support surface bracket 88, together with the intermediate guide 86, is pinned for rotation to the lower end of the shaft by a lock pin 108. The blade guide 90 mounted in the presser foot 92 also rotates about the axis of reciprocation with the support bracket 88 and the blade guide 86 due to the support posts 94, 96.

Accordingly, the cutting blade 20 is reciprocated along a vertical axis through the support shaft 84 and rotates about that axis with the shaft. The swivel 80 within the reciprocating drive linkage 54 permits the rotational motion of the blade relative to the eccentric 50 and at the same time ensures that the reciprocating motion is transmitted to the blade.

Figure 3:
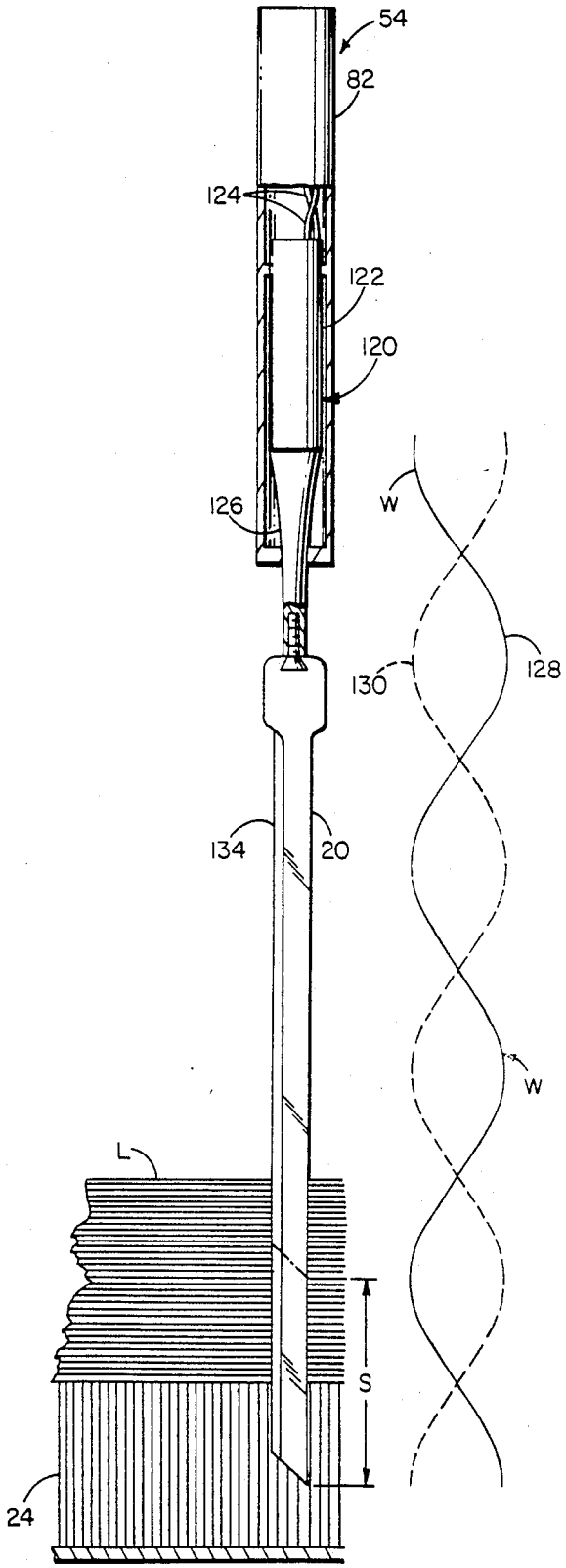
FIG. 3 is an enlarged fragmentary view showing the cutting blade and the ultrasonic transducer that establishes standing waves in the blade.

In accordance with the present invention, the cutting apparatus 10 includes in the cutting head an improvement comprised by an ultrasonic transducer in the reciprocating drive linkage 54. The transducer generates ultrasonic vibrations in the cutting blade 20 in the form of a standing wave extending along the elongated blade in the direction of the axis of reciprocation. FIG. 3 illustrates the details of the drive linkage including the ultrasonic transducer 120 enclosed within the cylindrical housing 82.

The ultrasonic transducer 120 is comprised by a piezoelectric ultrasonic generator 122 having a characteristic excitation frequency and an acoustic impedance transformer 126. The ultrasonic generator 122 is energized by a high frequency pulse train in the ultrasonic band, for example, 30,000 cycles through the conductors 124. The acoustic impedance transformer or horn 126 couples the generator 122 to the upper end of the elongated cutting blade 20. The connection between the cutting blade and the horn 126 is a firm, threaded connection to ensure that the vibrational energy is transmitted to the blade through the interface of the horn and the blade without significant attenuation. It is not essential that the generator be piezoelectric, and, if desired, equivalent magnetostrictive or electrodynamic generators may be used instead.

As shown in FIG. 3, the ultrasonic transducer 20 produces a standing wave W within the horn 126 and the cutting blade at the characteristic frequency. The wave W is theoretically comprised of a transmitted wave shown in a solid line and a reflected wave 130 shown by a dotted line, and represents the structural vibrations produced as the compression waves travel back and forth within the mechanical structure and produce mechanical vibrations proportional to the amplitude of the illustrated waves. It will be observed that with the standing wave there are nodes and antinodes distributed along the length of the horn and the blade. The separation between nodes is determined by the wavelength of the ultrasonic vibrations in the metal through which the wave passes, and in the case of a carbide steel, an ultrasonic frequency of 30,000 cps or higher produces nodes every few inches or less along the length of the blade. Accordingly, with a cutting blade that is five or six inches long, several nodes appear along the length of the blade as illustrated.

The nodes and antinodes of the wave W along the blade represent points of compression and expansion within the material, and it has been established that the minute movements of the blade at its cutting edge caused by the compression and expansion significantly assist in the severing of cloth as the blade advances along a cutting path through the layup L of limp sheet material. The movements associated with the vibrations are, of course, quite small compared to the substantially greater stroke of the reciprocating motion. The concept of using ultrasonics to improve the performance of cutting blades is well known in the art, as exemplified by U.S. Pat. Nos. 3,086,288; 3,610,080; and 3,817,141. However, one difficulty in applying the ultrasonic concept to the cutting of limp sheet material in multi-ply layups is that the nodes along the sharp, leading cutting edge 134 of the blade 20 are associated with minimal displacement of the edge and lead to less effective cutting in a particular ply of the layup where a node is located than where an antinode is located. In the present invention, however, the ultrasonic vibrations produced by the compression waves within the blade are superimposed upon the reciprocating motion of the blade so that the nodes and antinodes are shifted vertically between different plies of the layup, and therefore a particular ply of the layup is not continously exposed to the minimal vibrations. The net result is a general distribution of the effects of the nodes and antinodes throughout many plies of the layup.

To ensure that the effects of the nodes are adequately distributed through the layup, it is desirable to correlate the stroke S of the cutting blade with the wavelength of the ultrasonic vibrations. For example, as shown in FIG. 3, the stroke S of the blade is illustrated to be approximately of the same magnitude as the distance between the nodes of the standing wave W. Under these circumstances, the nodes and antinodes are moved above and below their nominal positions within the layup by an amount equal to a quarter wavelength, and thus each ply of the layup is exposed to the ultrasonic vibrations associated with both a node and an antinode. Under these conditions, the most effective distribution of the ultrasonic vibrations throughout the layup is achieved. Of course, the supplementation of the reciprocating motions of the blade with the ultrasonic vibrations is also effective with other wavelength and stroke relationships.

The ultrasonic generator 122 may take the form of the sonic wave generator disclosed in U.S. Pat. No. 3,328,610 issued to Jacke et al. Similar generators are commercially available from Smith Kline Ultrasonic Products of Newtown, Conn., and other companies.

The mounting of the ultrasonic transducer 120 in the reciprocating drive linkage 124 is accomplished using techniques which are well known in the art. In particular, the acoustic impedance transformer or horn 126 has a length approximately equal to half a wavelength, and the generator is connected with the horn and the cutting blade 20 so that a node exists at a longitudinal station midway between the generator and the blade. The node point becomes a desirable connection or mounting point for the transducer within the cylindrical housing 82 because the ultrasonic vibrations that would be transferred into the housing and the remaining linkage driven by the eccentric 50 are minimal. With this construction, there is, therefore, minimal feedback of ultrasonic vibrations into the other mechanical structure of the cutting head, and the maximum dispersal of energy from the transducer occurs within the cutting blade 20.

Figure 5:
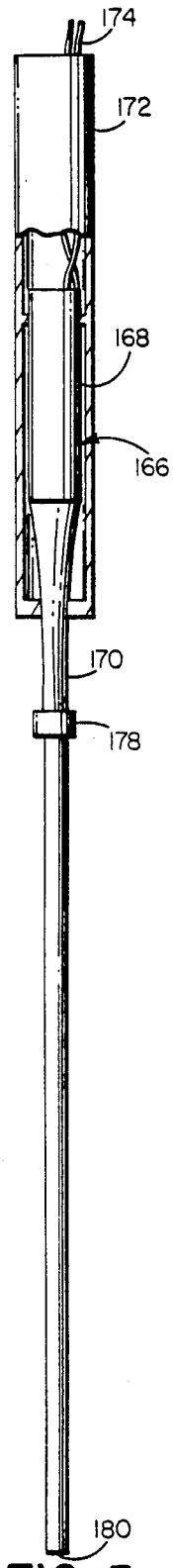
FIG. 5 is an enlarged fragmentary view showing the ultrasonic transducer connected with the drill.
Figure 4:
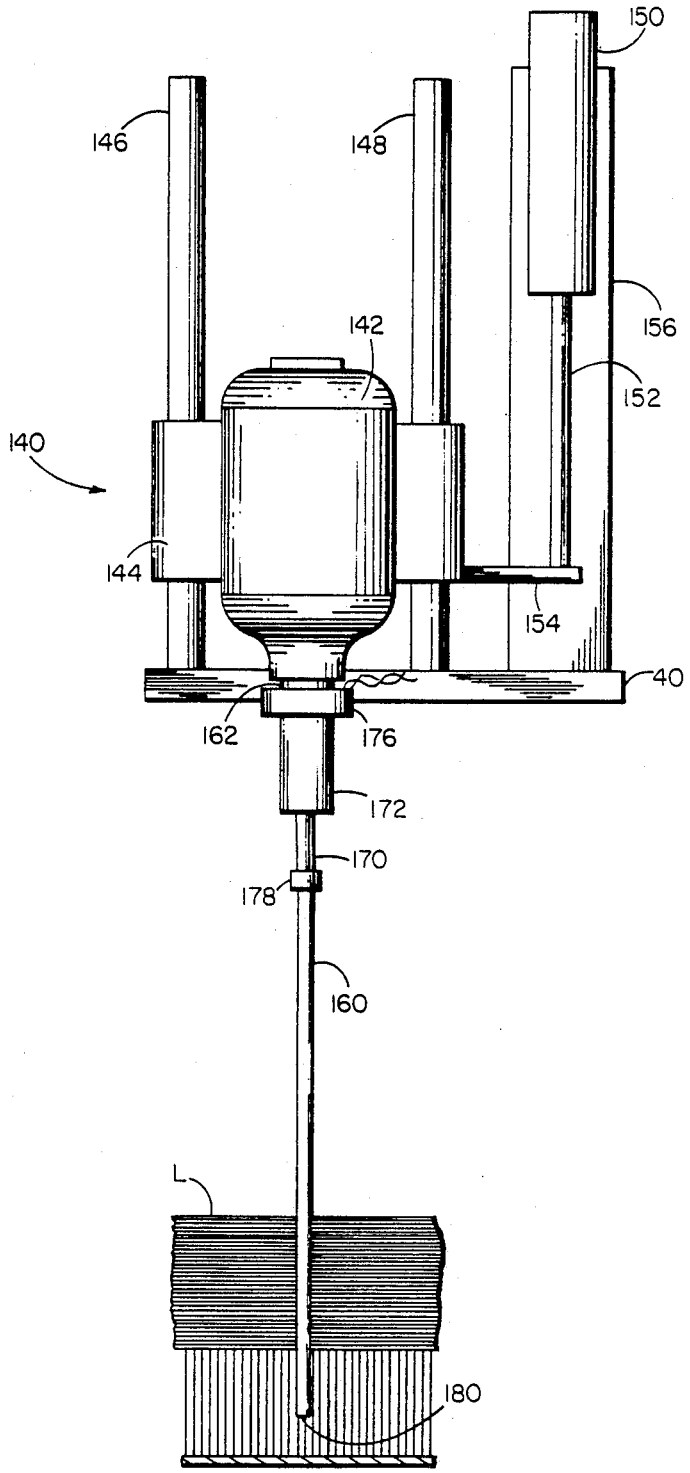
FIG. 4 is an elevation view showing a rotary drill mounted on the cutting head.

Another application of the ultrasonic transducing means in the cutting apparatus 10 is found in a drill utilized to produce holes through the layup L of limp sheet material for marking and other purposes. FIGS. 4 and 5 show such a drill in detail with the ultrasonic transducer added as an improvement. Apart from the transducer, the drill, generally designated 140, is conventional and is mounted with the cutting head on the platform 40 or a similar platform connected with the Y-carriage 28 for movement over any desired position of the cutting table 22.

The drill 140 includes a rotary drive motor 142 that is mounted on a slide assembly comprised by a slide 144 and two guide posts 146, 148. The slide is moved vertically along the guide posts by means of a pneumatic actuator 150 having a piston 152 connected to an extension 154 of the slide. The actuator is also mounted on the platform 40 by means of a bracket 156. Upon command from the computer controller 12, the drive motor 142 is energized and the actuator 150 presses the slide and the motor downward toward the layup L together with a rotary drill 160 connected to the motor drive shaft 162. The drill 160 is a standard cloth drill and generally comprises a hollow tube with a sharp circular cutting edge at the depending end for cutting through the limp sheet material. A discharging aperture may be provided at the top of the hollow drill for disposing of slugs that are cut from the sheet material. U.S. Pat. No. 3,730,634 discloses a drilling apparatus of this type.

In accordance with the present invention, an ultrasonic transducer 166 is connected between the drive shaft 162 and the drill 160. The details of the transducer 166 are shown more particularly in FIG. 5, and it will be apparent in this figure that the transducer has substantially the same structure as the transducer 120 connected to the cutting blade 20. The transducer includes an ultrasonic generator 168 and an acoustical impedance transformer 170 mounted within a cylindrical housing 172. The mechanical connection between the housing and the transducer is preferably near the midpoint of the transformer 170 at a vibrational node. The generator 168 is a piezoelectric, electrodynamic, or magnetostrictive generator and is energized through a slip ring assembly 176 in FIG. 4. Slip rings are required since the drill is rotated by the motor shaft 162 during a drilling operation. A coupling collar 178 provides a secure mechanical coupling between the transducer 166 and the drill for transmission of the vibrations to the drill in an axial direction without attenuation.

Since cutting by the drill takes place solely at the depending end 180, it is most desirable that the vibrations establish a standing wave in the drill, with maximum displacement at the lower end. Fortunately, load impedance also requires the reflected wave to be 180° out of synchronization with the transmitted wave at that point. In other words, the standing wave in the drill should have substantially the same configuration as the standing wave W in FIG. 3, and the frequency of the ultrasonic vibrations and correspondingly the wave length should be correlated with the length of the drill to provide a standing wave as shown in FIG. 3.

In summary, an automatically controlled machine for cutting limp sheet material has been disclosed in which the reciprocating motions of an elongated cutting blade are supplemented with ultrasonic vibrations to enhance the cutting operation. This object is accomplished by incorporating an ultrasonic transducer in the drive linkage which reciprocates the blade. The drill on the cutting machine is also augmented with an ultrasonic transducer to improve drilling operations through the same limp sheet material.

While the present invention has been described in a preferred embodiment, it should be understood that numerous modifications and substitutions can be had without departing from the spirit of the invention. As mentioned above, the generator from which the ultrasonic vibrations originate may be either a piezoelectric, electrodynamic, or a magnetostrictive type. Preferably, the generators are mounted by means of an acoustic impedance transformer at a node point, but other mounting structures can also be employed. The specific drive linkage illustrated for reciprocating the cutting blade is merely exemplary, and other linkages, for example, that shown in U.S. Pat. No. 4,048,891, can be supplemented with an ultrasonic transducer to improve cutter performance. Accordingly, the present invention has been described in a preferred embodiment by way of illustration rather than limitation.

I claim:

1. In an apparatus for automatically cutting limp sheet material including support means defining a penetrable support surface for holding the limp sheet material spread in a multi-ply layup, a cutting head mounted for movement relative to the penetrable support surface and the sheet material thereon with an elongated cutting blade, and reciprocation drive means for reciprocating the cutting blade along an axis extending generally perpendicular to the penetrable support surface, the cutting blade having a sharp leading cutting edge that is advanced through the limp sheet material along a cutting path in cutting engagement with the material during a cutting operation, and controlled motor means connected with the support means and the cutting head for moving the cutting blade and sheet material relative to one another along a predefined cutting path, the improvement comprising: a drive linkage in the reciprocation drive means including ultrasonic transducer means for superimposing on the reciprocating motions of the cutting blade ultrasonic vibration, the ultrasonic transducer means being cooperative with the cutting blade to establish ultrasonic vibrations in the form of a standing wave with multiple nodes, the wave extending longitudinally along the blade in the direction of the axis of reciprocation, and the reciprocating drive means includes means for reciprocating the cutting blade with a stroke substantially greater than the ultrasonic vibrations to move the nodes of the ultrasonic vibrations at the cutting edge of the blade between different plies of the layup of sheet material.

2. In an apparatus for automatically cutting limp sheet material the improvement as defined in claim 1 wherein the ultrasonic transducing means comprises an ultrasonic vibration generator and an acoustic impedance transformer extending between the generator and the cutting blade.

3. In an apparatus for automatically cutting limp sheet material the improvement as defined in claim 1 wherein the reciprocation drive means includes an eccentric reciprocating the drive linkage and the cutting blade with a stroke substantially greater than the ultrasonic vibrations to move the nodes of the ultrasonic vibrations at the cutting edge of the blade between different plies of the layup of sheet material.

4. In an apparatus for automatically cutting limp sheet material the improvement as defined in claim 1 wherein the ultrasonic transducer has a characteristic frequency and the length of the elongated cutting blade is selected to establish the ultrasonic vibrations in a standing wave in the blade at the characteristic frequency.

5. In a method of cutting limp sheet material with an automatically controlled cutting machine having a support surface on which a multi-ply layup of limp sheet material is held for cutting by an elongated cutting blade, the blade being reciprocated along an axis extending generally perpendicular to the support surface and being advanced under program control along a predefined cutting path with the sharp, leading cutting edge of the blade cutting through the material as the blade is advanced and reciprocated, the improvement comprising superimposing on the reciprocating motion of the cutting blade ultrasonic vibrations in the form of a standing wave with multiple nodes, the wave extending longitudinally along the length of the blade in the direction of the axis of reciprocation and reciprocating the blade to cause the nodes at the cutting edge to move between different plies of the layup as the cutting blade is advanced in cutting engagement with the material.

6. In a method of cutting limp sheet material, the improvement of claim 5 wherein the step of reciprocating the cutting blade is carried out with a stroke of approximately the same magnitude as the distance between nodes of the standing wave.

* * * * *